US005832724A

United States Patent [19]

Watanabe et al.

[11] Patent Number: 5,832,724

[45] Date of Patent: Nov. 10, 1998

[54] AIR-FUEL RATIO CONTROL SYSTEM FOR ENGINES

[75] Inventors: Tomomi Watanabe; Junichi Taga; Fumihiko Saito, all of Hiroshima, Japan

[73] Assignee: Mazda Motor Corporation, Hiroshima, Japan

[21] Appl. No.: 592,734

[22] Filed: Jan. 26, 1996

[30] Foreign Application Priority Data

Jan. 27, 1995 [JP] Japan ..... 7-031606

[51] Int. Cl.[6] ..... F01N 3/00

[52] U.S. Cl. ..... 60/276; 60/277; 60/288; 123/688; 123/685

[58] Field of Search ..... 60/284, 277, 276, 60/288; 123/688, 691, 685

[56] References Cited

U.S. PATENT DOCUMENTS 5,090,199 2/1992 Ikuta ..... 60/285

5,159,810 11/1992 Grutter ..... 60/285

FOREIGN PATENT DOCUMENTS 51-127927 4/1975 Japan .

59-208141 11/1984 Japan .

6-129294 5/1994 Japan .

*Primary Examiner*—Thomas E. Denion

*Attorney, Agent, or Firm*—Martin Fleit

[57] ABSTRACT

An air-fuel control system for an internal combustion engine is equipped with an exhaust system having a catalytic converter, a linear $O_2$ sensor and a $\lambda O_2$ sensor for feedback controlling an air-fuel ratio on the basis of output representative of oxygen content from at least the linear $O_2$ sensor. The system delivers a target air-fuel ratio of a fuel mixture. A determinant output, based on which the air-fuel ratio is feedback controlled, is shifted from output from the linear $O_2$ sensor to output from the $\lambda O_2$ sensor before the linear $O_2$ sensor is effectively active.

20 Claims, 7 Drawing Sheets

AIR-FUEL RATIO CONTROL SYSTEM FOR ENGINES

BACKGROUND OF THE INVENTION

1. Field of the Invention

The present invention relates to an air-fuel ratio control system for an internal combustion engine.

2. Description of Related Art

Air-fuel ratio control systems typically utilize linear type oxygen ($O_2$) sensors which provide continually variable monitoring of the air-fuel ratio of an air-fuel mixture and perform feedback control for bringing the air-fuel ratio to a target air-fuel ratio leaner than a theoretical or stoichiometric air-fuel ratio. Such an air-fuel control system is known from, for instance, Japanese Unexamined Patent Publication No. 59 - 208,141. Further, as is known from, for instance, Japanese Unexamined Patent Publication No. 51 - 127,927, in cases in which feedback control of the air-fuel ratio of a fuel mixture is performed, a lambda type oxygen ($\lambda O_2$) sensor, which provides sudden changes in its output in the vicinity of a theoretical or stoichiometric air-fuel ratio of a fuel mixture, is installed together with the aforementioned linear oxygen ($O_2$) sensor in an exhaust system on a side upstream from a catalytic converter. Further, as is known from, for instance, Japanese Unexamined Patent Publication No. 6 - 129,294, an oxygen ($O_2$) sensor is installed in an exhaust system on each side of a catalytic converter so as to monitor catalytic converter performance and adjust the air-fuel ratio at the time when deterioration of the catalytic converter is detected.

Compared to a feedback control system using a lambda oxygen ($\lambda O_2$) sensor in which an air-fuel ratio is controlled and brought toward the theoretical or stoichiometric air-fuel ratio (an excess air ratio=1), a feedback control system employing a linear oxygen ($O_2$) sensor offers a wider range of feedback control. This wider range of feedback control covers rich fuel mixtures (which have smaller excess air ratios) richer than a stoichiometric fuel mixture and lean fuel mixtures (which have larger excess air ratios) leaner than the stoichiometric fuel mixture. As a result, a feedback control system employing a linear oxygen sensor is able to improve emission control and operating performance of the engine. Linear oxygen ($O_2$) sensors, which typically use zirconium oxide elements, output a pump current value as a linear variable as influenced by the air-fuel ratio when applying a pump current so as to maintain a constant electromotive force of the power cell. The linear oxygen ($O_2$) sensor has an activation temperature of approximately 700° to 800° C. which is significantly higher than the activation temperature of approximately 300° C. of the lambda oxygen $\lambda O_2$) sensor and demonstrates poor lasting quality unless the temperature of the linear oxygen ($O_2$) sensor is raised in conformity with a rise in ambient temperature. Consequently, the linear oxygen ($O_2$) sensor takes a significant time until it attains the activation temperature. Generally, this time extends over approximately 80 seconds from an engine start under normal ambient temperature. As a result, when a linear oxygen ($O_2$) sensor is employed, the feedback control can not be provided during the long time it takes for the linear oxygen ($O_2$) sensor to reach its activation temperature. A particular problem which occurs upon a cold engine start is that the feedback control is prevented for a significantly long time after the engine start and, during this time, an adverse effect in control precision and a falloff in exhaust gas emission control performance are caused.

SUMMARY OF THE INVENTION

It is an object of the present invention to provide an air-fuel ratio control system which prevents a falloff in air-fuel ratio control performance during a time needed for a linear oxygen ($O_2$) sensor to attain its activation temperature after an engine start so as thereby to provide improved exhaust gas emission control performance.

The aforesaid object of the present invention is achieved by providing an air-fuel control system which utilizes multiple oxygen sensors installed in an exhaust system to monitor oxygen content in the exhaust gas on the basis of which the air-fuel ratio of a fuel mixture to be supplied to a combustion chamber of each cylinder is controlled. One of the oxygen sensors is a linear oxygen ($O_2$) sensor which provides an output signal which is linearly and continuously variable according to changes in exhaust gas oxygen content but is relatively slow in activation. Another of the aforesaid oxygen sensors is a lambda oxygen ($\lambda O_2$) sensor which is able to provide a sudden or sharp change in output signal at an exhaust gas oxygen content representative of approximately a theoretical or stoichiometric air-fuel ratio. The linear oxygen ($O_2$) sensor may be of a type providing a gentle or relatively dull change in output signal as compared to the lambda oxygen ($\lambda O_2$) sensor. The air-fuel ratio control system controls an air-fuel ratio in feedback control on the basis of output from at least the linear oxygen ($O_2$) sensor so as to deliver a target air-fuel ratio of a fuel mixture to the combustion chamber. The air-fuel ratio control system includes a sensor monitoring means for monitoring effective activation of the linear oxygen ($O_2$) sensor and a means for shifting determinant output based on which the air-fuel ratio is feedback controlled to an output signal from the lambda oxygen ($\lambda O_2$) sensor, instead of an output signal from the linear oxygen ($O_2$) sensor, before the linear oxygen ($O_2$) sensor is effectively activated. The linear oxygen ($O_2$) sensor and the lambda oxygen ($\lambda O_2$) sensor are installed in the exhaust system before and after a catalytic converter, respectively. Activation of the linear oxygen sensor is determined as being effective or achieved on the basis of a specified time duration from a time at which an engine is initially started. Output from both oxygen sensors may be utilized to detect catalytic activity conditions and/or malfunctions of the linear oxygen ($O_2$) sensor.

According to another aspect of the present invention, the air-fuel control system may also be equipped with exhaust gas bypass means to divert exhaust gas around the catalytic converter to the lambda oxygen ($\lambda O_2$) sensor. The exhaust gas bypass means comprises a bypass conduit and a valve which is disposed in the bypass conduit and operated to open and close the bypass conduit before effective activation of the linear oxygen ($O_2$) sensor but after effective activation of the catalytic converter. The activation of the linear oxygen ($O_2$) sensor is detected by monitoring a time duration after an engine start.

According to another aspect of the present invention, the air-fuel control system utilizes proportional and integral control values in feedback control of the air-fuel ratio. The integral control value is altered so that it is smaller according to activity of the catalytic converter before the linear oxygen ($O_2$) sensor is activated than after this sensor has been activated. In addition, the proportional control value may be altered so that it is larger according to activity of the catalytic converter before the linear oxygen ($O_2$) sensor is activated than after this sensor has been activated.

In the air-fuel control system of the invention, the feedback control of the air-fuel ratio is executed by utilizing the lambda oxygen ($\lambda O_2$) sensor, which is of a type reaching its activation temperature relatively quickly, during a time interval when the feedback control can not be based on the output of the linear oxygen ($O_2$) sensor as determinant output due to the relatively slow activation of the linear oxygen ($O_2$) sensor. This provides the benefit of preventing a falloff in feedback control precision during the time interval needed for the linear oxygen ($O_2$) sensor to attain its effective activity or reach its effective activation temperature. After the linear oxygen ($O_2$) sensor attains its effective activity, the air-fuel control system shifts the feedback control to a control mode based on output of the linear oxygen ($O_2$) sensor, which yields a wide range of air-fuel ratio mixture feedback control covering lean to rich mixtures.

In a case in which the lambda oxygen $\lambda O_2$) sensor is installed in the exhaust system downstream from the catalytic converter so as to monitor an activated condition of the catalytic converter or a functional malfunction of the linear oxygen ($O_2$) sensor installed in the exhaust system upstream from the catalytic converter, the lambda oxygen ($\lambda O_2$) sensor is available to execute the air-fuel ratio feedback control until the linear oxygen ($O_2$) sensor attains its effective activity. The attainment of the effective activity of the linear oxygen ($O_2$) sensor is detected by, for example, monitoring a time duration from an initial engine start.

The exhaust gas bypass means allows exhaust gas to flow directly to the lambda oxygen $\lambda O_2$) sensor and bypass the catalytic converter after the catalytic converter attains effective activity but before the linear oxygen ($O_2$) sensor attains the effective activity. A falloff in feedback control precision is prevented by executing the feedback control on the basis of output from the lambda oxygen ($\lambda O_2$) sensor installed downstream from the catalytic converter after attaining effective activation of the catalytic converter but before the linear oxygen ($O_2$) sensor reaches its activation temperature.

The air-fuel ratio feedback control utilizes proportional and integral control values. The integral control value is set smaller according to an activated condition of the catalytic converter during a time interval before the linear oxygen ($O_2$) sensor has attained effective activity than after the linear oxygen ($O_2$) sensor has attained effective activity. On the other hand, the proportional control value is set greater according to an activated condition of the catalytic converter during a time interval before the linear oxygen ($O_2$) sensor has attained effective activity than after the linear oxygen ($O_2$) sensor has attained effective activity. These settings result in suppression of fluctuations in frequency of an air-fuel ratio and an enhanced amplitude of the air-fuel ratio as compared with when the lambda oxygen $\lambda O_2$) sensor is activated, according to an activated condition of the catalytic converter, until the linear oxygen ($O_2$) sensor is activated. Consequently, performance of the lambda oxygen ($\lambda O_2$) sensor is sustained with the effect of preventing aggravation of precision in the air-fuel ratio feedback control based on the lambda oxygen ($\lambda O_2$) sensor after the catalytic converter has been activated but before the linear oxygen ($O_2$) sensor has been activated.

BRIEF DESCRIPTION OF THE DRAWINGS

The above and other objects and features of the present invention will be clearly understood from the following description of a preferred embodiment thereof when considered in conjunction with the accompanying drawings, in which.

DETAILED DESCRIPTION OF THE PREFERRED EMBODIMENTS

Figure 1:
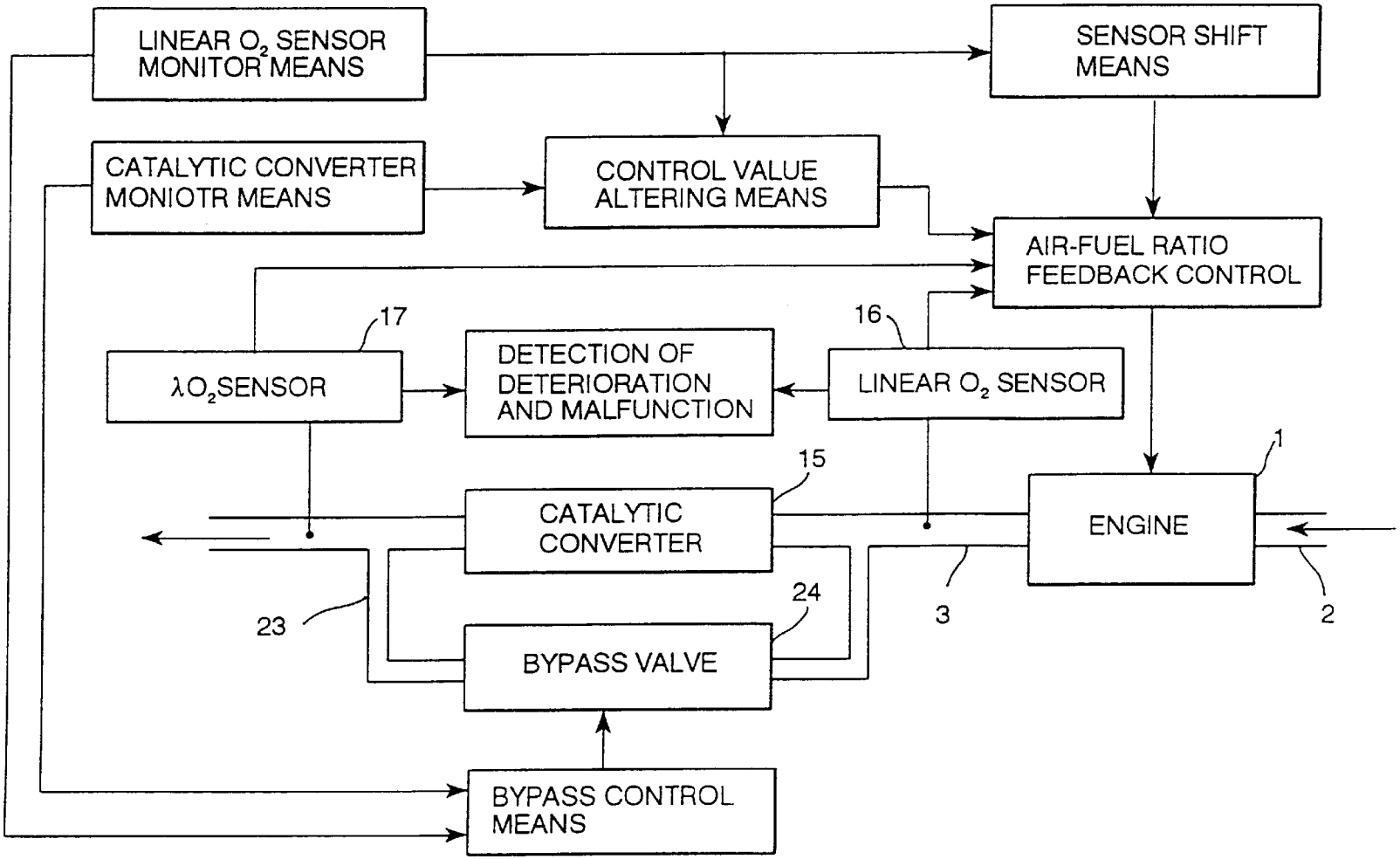
FIG. 1 is a conceptual block diagram showing an overall structure of an air-fuel ratio control system of the present invention.
Figure 2:
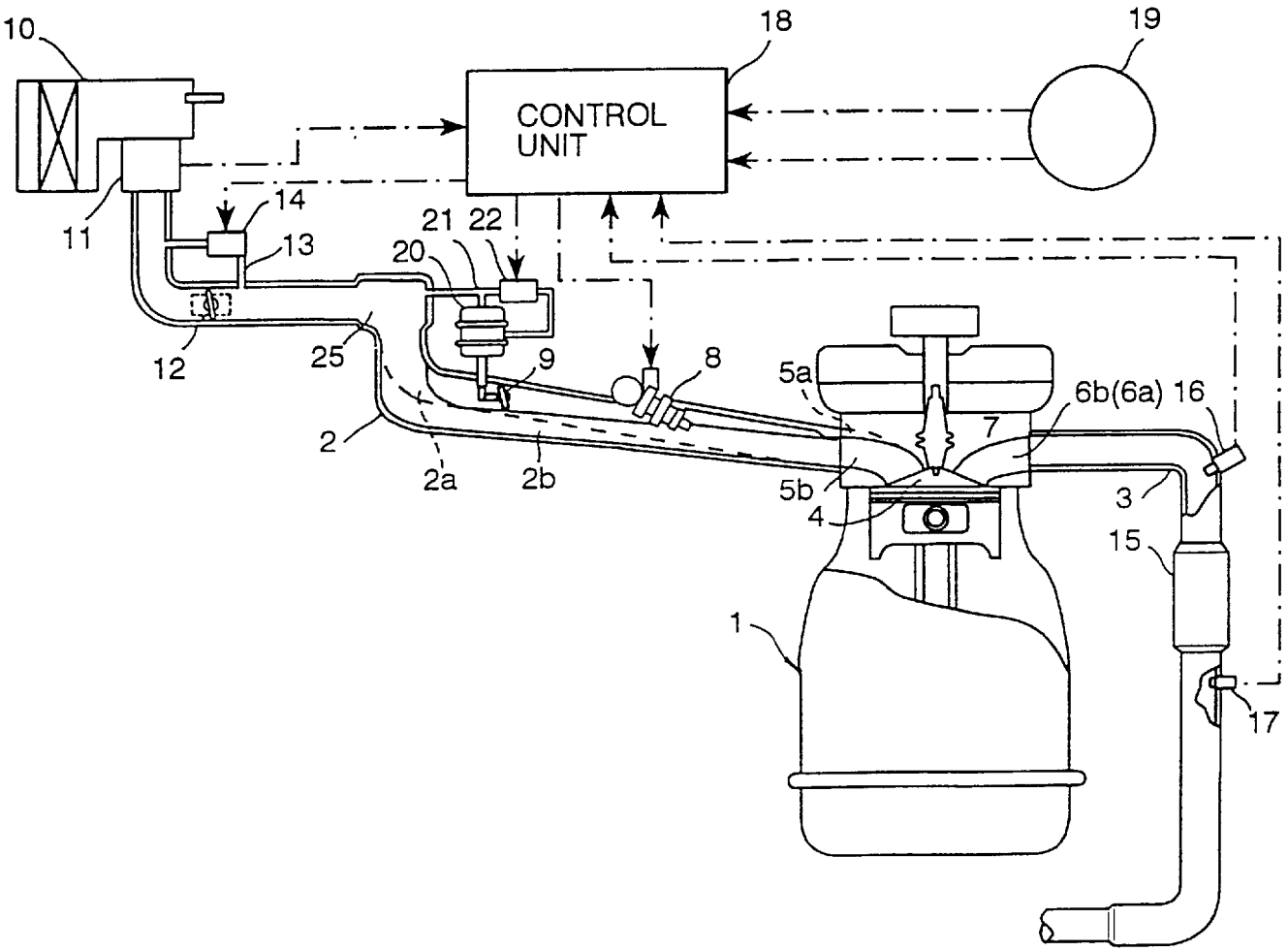
FIG. 2 is a schematic view of the air-fuel ratio control system in accordance with an embodiment of the present invention.

FIGS. 1 and 2 show an internal combustion engine 1 equipped with an air-fuel control system in accordance with an embodiment of the present invention. The engine 1 is provided with an air intake pipe 2 and an exhaust pipe 3. The engine 1 has intake ports 5*a* and 5*b* and exhaust ports 6*a* and 6*b* opening into a combustion chamber 4 of each of a plurality of cylinders (only one of which is shown in FIG. 1). A spark plug 7 is installed at each combustion chamber 4. The air intake pipe 2 branches off or is divided at a position downstream from a surge tank 25 into two pipe portions 2*a* and 2*b* independently extending to the intake ports 5*a* and 5*b*, respectively.

One of these intake ports 5*a* and 5*b* at each cylinder, for instance the intake port 5*a* in this embodiment, is formed as a tumble port which induces a "tumble" (vertical vortex turbulence) in the cylinder. The other intake port, 5*b*, is formed as a swirl port which induces a "swirl" (horizontal vortex turbulence) in the cylinder. The independent intake pipe portion 2*b* to which the swirl port 5*b* (which is referred to as a primary intake port) is connected is equipped with a fuel injector 8. The independent intake pipe portion 2*a* to which the tumble port 5*a* (which is referred to as a secondary intake port) is connected has a tumble-swirl control valve (TSCV) which opens and closes the independent intake pipe portion 2*a* so as to control the generation of a slanting helical swirl which is turbulence resulting from both tumble and swirl turbulence in the cylinder.

The air intake pipe 2 is provided, in order from its upstream end, with an air cleaner 10, an air flow meter 11 directly after the air cleaner 10, and a throttle valve 12 between the air flow meter 11 and the surge tank 25. An idle speed control (ISC) conduit 13 is installed around the throttle valve 12 in such a manner as to allow intake air to bypass the throttle valve 12. The idle speed control (ISC) conduit 13 has an idle speed control (ISC) valve 14 for opening and closing the idle speed control (ISC) conduit 13 to control the speed of the engine during idling. The exhaust pipe 3 is provided with a catalytic converter 15. On upstream and downstream sides of the catalytic converter 15, the exhaust pipe 3 has a linear oxygen ($O_2$) sensor (which is hereafter referred to as a linear $O_2$ sensor for simplicity) 16 and a lambda oxygen sensor ($\lambda O_2$) sensor (which is hereafter referred to as a $\lambda O_2$ sensor for simplicity) 17, respectively. The linear $O_2$ sensor 16 utilizes a zirconium oxide element which outputs a pump current value as a linear variable as influenced by the air-fuel ratio when the pump current is applied so as to hold an electromotive force of the power cell constant and thus, as is well known in the art, provides an output which continually changes in response to fluctuations in the air-fuel ratio. The linear $O_2$ sensor 16 has an activation temperature of approximately 700° to 800° C. The $\lambda O_2$ sensor 17 exhibits sudden changes in its output in the vicinity of the stoichiometric air-fuel ratio, as is well known in the art, and typically has an activation temperature of approximately 300° C.

A microcomputer-equipped control unit 18 is connected to the engine 1. This control unit 18 is supplied with various signals including an engine speed signal and a crank angle signal from a crank angle sensor 19, an intake air volume signal from the air flow meter 11, and air-fuel ratio signals from the linear $O_2$ sensor 16 and $\lambda O_2$ sensor 17. Moreover, a signal denoting the operated extent of an accelerator is also supplied to the control unit 18. On the basis of these signals, the control unit 18 establishes the air-fuel ratio of the fuel mixture delivered to the cylinders by controlling operation of the fuel injector 8, sets the rate of swirl turbulence by controlling operation of the tumble-swirl control valve (TSCV) 9, and establishes an engine idle speed through controlling operation of the idle speed control (ISC) valve 14.

In the air-fuel control, an air-fuel ratio map, established with the operated extent of the accelerator and engine speed as parameters, is utilized. This map defines, for instance, a lean range of an air-fuel ratio of 22 (a lean air-fuel ratio range) for low engine speeds and low engine loads, a stoichiometric air-fuel ratio range for engine loads higher than those for the lean air-fuel ratio range, and an enriched range of an air-fuel ratio of 13 for engine loads higher than those for the lean air-fuel ratio range and stoichiometric air-fuel ratio range. A target air-fuel ratio for each range is determined based on an engine speed and the amount of charged air, and a basic amount of fuel to be injected is determined based on an engine speed and the amount of intake air. After correcting the basic amount of fuel injection according to the temperature of engine cooling water and other factors, the air-fuel ratio feedback correction is applied based on the differential between the target air-fuel ratio and an air-fuel ratio monitored by the linear $O_2$ sensor 16 to the eventual amount of fuel to be delivered by the fuel injector 8. The control unit 18 adjusts an injection pulse width so as to deliver the eventual amount of fuel by the fuel injector 8, thereby trying to deliver the target air-fuel ratio.

The $\lambda O_2$ sensor 17 serves to monitor the catalytic reaction status, or otherwise deterioration, of the converter 15 and the operating status, or otherwise malfunctions, of the linear $O_2$ sensor 16. As is well known in the automobile art, installing the linear $O_2$ sensor 16 in the exhaust system at a location upstream from the catalytic converter 15 and installing the $\lambda O_2$ sensor 17 in the exhaust system at a location downstream from the catalytic converter 15 can permit detection of the reaction status of the catalytic converter 15 and the operating status of the linear $O_2$ sensor 16 based on output of both oxygen sensors 16 and 17. The air-fuel ratio control system shown in FIG. 1 utilizes the $\lambda O_2$ sensor 17, in place of the linear $O_2$ sensor 16, to execute the air-fuel ratio control from a time the engine 1 is initially started until a time at which the linear $O_2$ sensor 16 attains its activation temperature. Whenever the linear $O_2$ sensor 16 attains the activation temperature, it is utilized to execute the air-fuel ratio control. In this instance, the activation temperature of the linear $O_2$ sensor 16 may be assumed as being attained after a set period of time of, for example, approximately 80 seconds after the initial engine start. This set period of time is adjusted according to ambient temperature.

A diaphragm-type of actuator 20, which is installed to the tumble-swirl control valve (TSCV) 9, is of a type having double activation chambers. Each activation chamber is connected to the intake pipe 2 by a conduit 21 through which the activation chamber is applied with the intake air at negative pressure existing downstream from the throttle valve 12. A three-way solenoid valve 22 is installed in the conduit 21 so as to be able to selectively open one of the two activation chambers of the actuator 20 to the atmosphere. The tumble-swirl control valve (TSCV) 9 opens when a predetermined level of negative pressure is introduced into both actuator chambers and sets one of two given positions according to positions of the three-way solenoid valve 22. In the lean air-fuel ratio range, the negative pressure fed to the actuator chambers from the downstream side of the throttle valve 12 acts to close the tumble-swirl control valve (TSCV) 9 when that negative pressure surpasses a specified level. When the speed of the engine surpasses a specified speed in the lean air-fuel ratio range, the three-way solenoid valve 22 opens one side of one of the two activation chambers of the actuator 20 to the atmosphere, thus causing the tumble-swirl control valve (TSCV) 9 to open half way only to generate a weak swirl in the cylinder. On the other hand, when the speed of the engine falls below the specified speed in the lean air-fuel ratio range, the three-way solenoid valve 22 operates to allow the negative pressure to be fed to both activation chambers, thus causing the tumble-swirl control valve (TSCV) 9 to close completely and generate a strong swirl in the cylinder. Because the negative pressure falls below the specified value in the theoretical air-fuel ratio range, the actuator 20 does not operate and thus leaves the tumble-swirl control valve (TSCV) 9 in a completely open position, which results in weakening the swirl in the cylinder.

Figure 3:
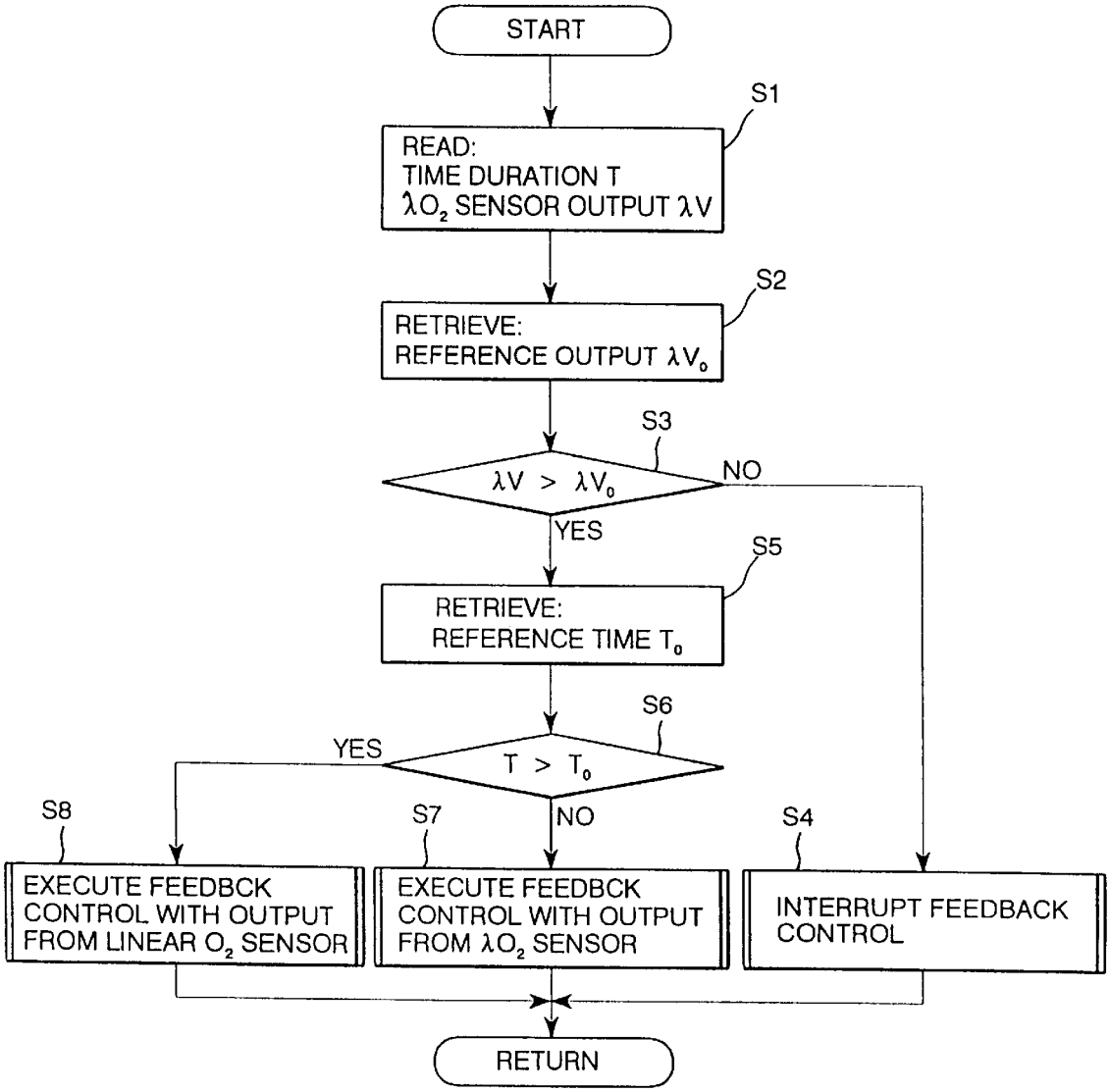
FIG. 3 is a flow chart illustrating the air-fuel ratio feedback control sequential routine.

FIG. 3 is a flow chart illustrating the air-fuel ratio feedback control sequential routine. Operation flow consists of eight steps in which, when control starts, sensor output (V and $\lambda V$) from the $O_2$ and $\lambda O_2$ sensors 16 and 17 and a time duration (T) from the engine start are read in at step S1. A reference value of sensor output ($\lambda V_0$), which is used to determine the achievement of activation of the $\lambda O_2$ sensor 17, is read in at step S2. Subsequently, at step S3, a decision is made as to whether or not the $\lambda O_2$ sensor 17 has been activated by comparing the sensor output ($\lambda V$) with the reference sensor output ($\lambda V_0$). If the $\lambda O_2$ sensor 17 has not yet been activated, then it provides a sensor output ($\lambda V$) equal to or smaller than the reference sensor output ($\lambda V_0$). If the $\lambda O_2$ sensor 17 has been activated, then it provides sensor output ($\lambda V$) larger than the reference sensor output ($\lambda V_0$). When the answer to the decision made in step S3 is "NO", this indicates that the $\lambda O_2$ sensor 17 has not yet been activated. The control then advances to step S4 where the feedback control of air-fuel ratio is interrupted and orders return. When the answer to the decision made in step S3 is "YES", this indicates that the $\lambda O_2$ sensor 17 has been activated. The control then advances to step S5 where a reference time duration ($T_0$), which is used to determine the achievement of activation of the linear $O_2$ sensor 16, is read in. At step S6, a decision is made as to whether or not the linear $O_2$ sensor 16 has been activated by comparing the time duration (T) with the reference time duration ($T_0$). If the time duration (T) is equal to or shorter than the reference time duration ($T_0$), then it is assumed that the linear $\lambda O_2$ sensor 16 has not yet been activated. If the time duration (T) is longer than the reference time duration ($T_0$), then it is assumed that the linear $O_2$ sensor 16 has been activated. When the answer to the decision made in step S6 is "NO", this indicates that the linear $O_2$ sensor 16 has not yet been activated. Then, the control advances to step S7, where the feedback control of air-fuel ratio is executed based on the sensor output ($\lambda V$) from the $\lambda O_2$ sensor 17, and then returns. If the answer to the decision made in step S6 is "YES, then this indicates that the linear $O_2$ sensor has attained its activation temperature. The control advances then to step S8 where the feedback control of the air-fuel ratio is executed based on the sensor output (V) from the linear $O_2$ sensor 16. After this, the control returns.

Figure 4:
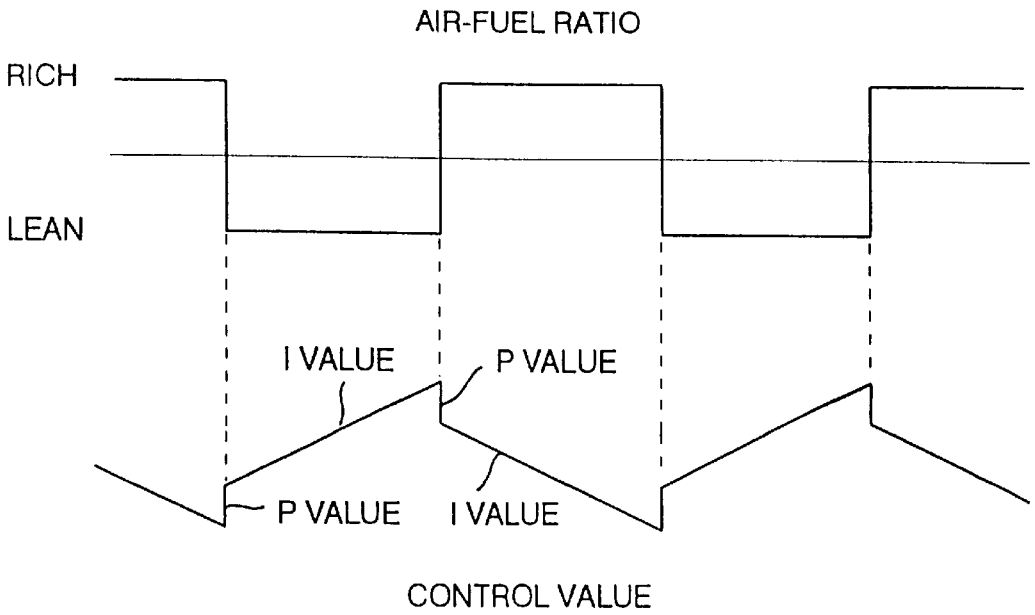
FIG. 4 is a time chart of feedback control value alteration.

As is clear from FIG. 4, in a feedback control of air-fuel ratio based on sensor output from the $\lambda O_2$ sensor 17, if the $\lambda O_2$ sensor 17 monitors an air-fuel ratio representing a rich fuel mixture, then the control system tries to deliver a lean fuel mixture by correcting the air-fuel ratio with an integral value I which linearly and decreasingly changes. On the other hand, if the $\lambda O_2$ sensor 17 monitors an air-fuel ratio representing a lean fuel mixture, then the control system tries to deliver a rich fuel mixture by correcting the air-fuel ratio with an integral value I which linearly and increasingly changes. When the $\lambda O_2$ sensor 17 detects a transition of an air-fuel ratio, indicating that the fuel mixture has changed from rich to lean or vice versa, correction of the air-fuel ratio is made with a fixed proportional value P. In this manner, the control system provides feedback control to deliver an appropriate air-fuel ratio within a specified range.

The $\lambda O_2$ sensor 17 positioned after the catalytic converter 15 may experience a falloff in performance efficiency which occurs when the catalytic converter 15 has been activated earlier than the linear $O_2$ sensor 16 while output of the $\lambda O_2$ sensor 17 is used as the basis of air-fuel ratio feedback control until the linear $O_2$ sensor has been activated. In order to prevent the occurrence of a falloff in the performance efficiency of the $\lambda O_2$ sensor 17, a bypass conduit may be installed to the catalytic converter 15.

Figure 5:
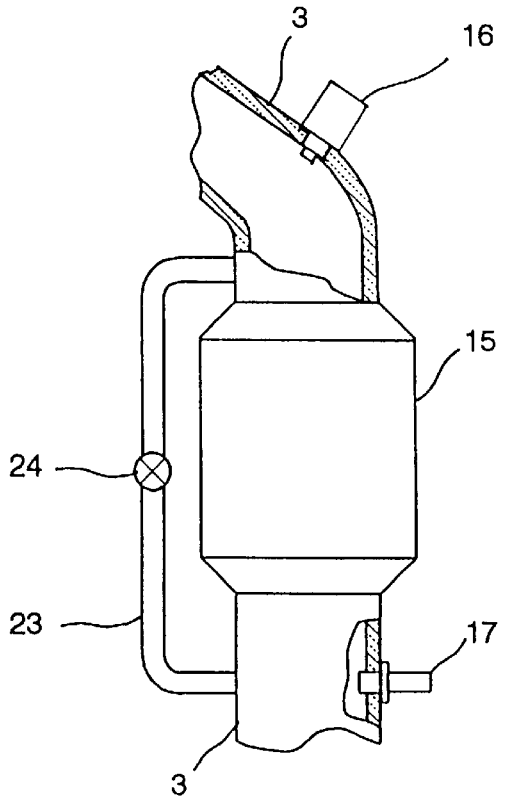
FIG. 5 is a schematic illustration showing an exhaust system involved in an air-fuel ratio control system in accordance with an embodiment of the present invention.

Referring to FIG. 5, a bypass conduit 23 is installed to the catalytic converter 15 so as to allow exhaust gas to reach to the $\lambda O_2$ sensor 17 directly without passing through the catalytic converter 15. A bypass valve 24 is installed in the exhaust bypass conduit 23 to stop or allow a flow of exhaust gas through the conduit 23. The bypass valve 24 opens to allow exhaust gas to flow directly to the $\lambda O_2$ sensor 17 during a time when the catalytic converter 15 has attained its activation temperature but the linear $O_2$ sensor 16 has not, thus preventing a falloff in the feedback control of an air-fuel ratio based on output from the $\lambda O_2$ sensor 17 until the linear $O_2$ sensor 16 is activated after the catalytic converter 15 has been activated. The overall system of this second embodiment operates in essentially the same manner as described previously in relation to the first embodiment.

Figure 6:
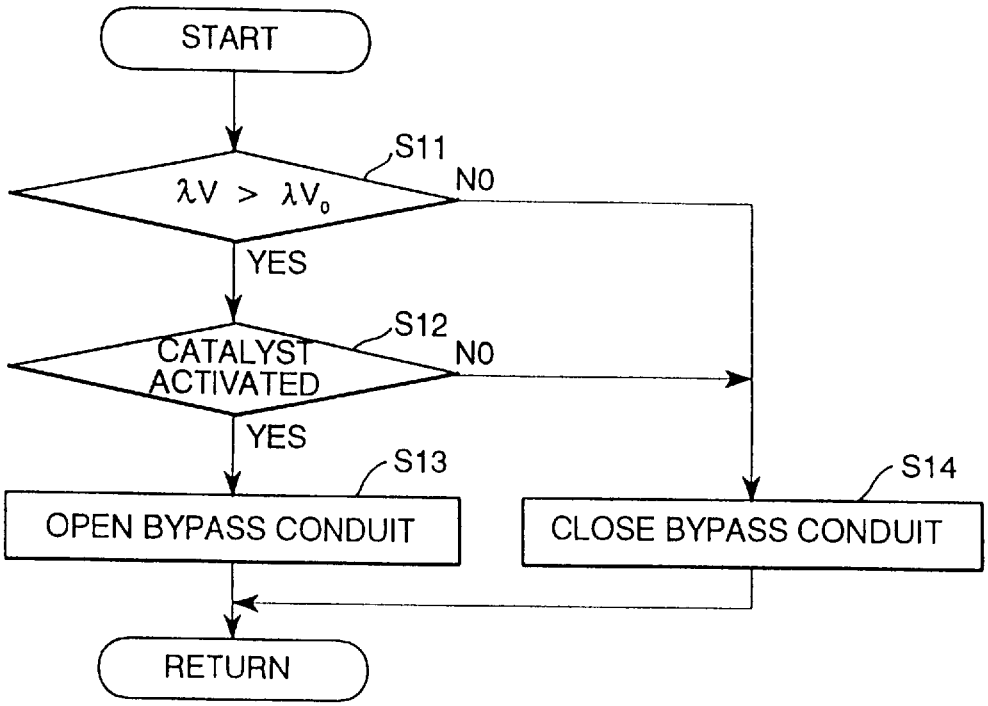
FIG. 6 is a flow chart illustrating the bypass control sequential routine of an exhaust gas bypass means of the exhaust system shown in FIG. 5.

FIG. 6 shows a flow chart illustrating the bypass control sequential routine of the bypass valve 24. When control starts in response to an engine start, a decision is made at step S11 as to whether or not the $\lambda O_2$ sensor 17 has been activated. This decision is made by comparing sensor output $\lambda V$ from the $\lambda O_2$ sensor 17 with the reference sensor output $\lambda V_0$. If the $\lambda O_2$ sensor 17 has been activated, that is, the sensor output $\lambda V$ is greater than the reference sensor output $\lambda V_0$, the control proceeds to step S12 where activation of the catalytic converter 15 is determined based on the sensor output $\lambda V$ from the $\lambda O_2$ sensor 17. If the catalytic converter 15 has not yet been activated, then the control proceeds to step S13 where the bypass conduit 23 is closed through the bypass valve 24. If the catalytic converter 15 has been activated, then the bypass valve 24 is actuated to open the exhaust bypass conduit 23 at step S14. If it is determined at step S11 that the $\lambda O_2$ sensor 17 has not yet been activated, that is, the sensor output $\lambda V$ is equal to or smaller than the reference sensor output $\lambda V_0$, then the bypass control valve 24 closes the exhaust bypass conduit 23.

In order to prevent a falloff in the performance efficiency of the $\lambda O_2$ sensor 17 after activation of the catalytic converter 15, the feedback control of the air-fuel ratio may be executed with use of a feedback correction value established from proportional and integral terms based on a monitored air-fuel ratio. Until the linear $O_2$ sensor 16 is activated but after the catalytic converter 15 has been activated, the value P of a proportional term (which is referred to as a proportional value) and the value I of an integral term (which is referred to as an integral value) are altered according to the status of activation of the linear $O_2$ sensor 16 in the feedback control.

Figure 7:
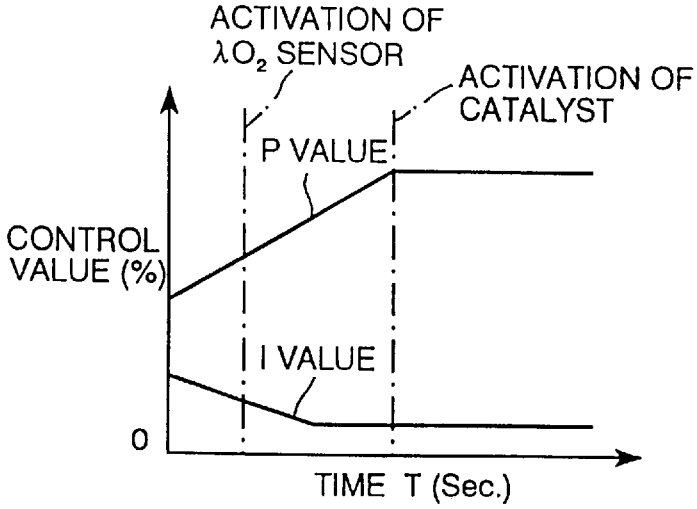
FIG. 7 is an illustration showing a map of proportional and integral control values used before effective activation of a linear oxygen sensor.

FIG. 7 shows a map of the proportional value (P) and integral value (I) before the linear $O_2$ sensor 16 activates. During the time when the linear $O_2$ sensor 16 and catalytic converter 15 are both in a non-activated condition, the map sets the integral value (I) so as to become smaller then a normally employed value with a time duration from an engine start. However, the proportional value (P) is set so as to become larger than a normally employed value with a time duration from an engine start. Further, the proportional and integral values P and I return to the normal settings when the linear $O_2$ sensor 16 activates. As a result of thus changing the proportional and integral values P and I in these ways, while fluctuations in frequency of an air-fuel ratio is suppressed, the amplitude of the air-fuel ratio is enhanced, as compared with when the ° $O_2$ sensor 17 is activated, according to the status of activation of the catalytic converter until the linear $O_2$ sensor 16 is activated. This sustains monitoring performance of the $O_2$ sensor 17 which, in turn, prevents aggravation of precision in the air-fuel ratio feedback control based on the sensor output from the $\lambda O_2$ sensor 17 after the catalytic converter 15 has been activated but before the linear $\lambda O_2$ sensor has been activated. The control system of this embodiment has essentially the same structure and operation as that described in connection with the previous embodiments. Furthermore, as stated previously, the activated status of the catalytic converter 15 may be determined based on catalyst temperature rather than on the basis of a duration time.

Figure 8:
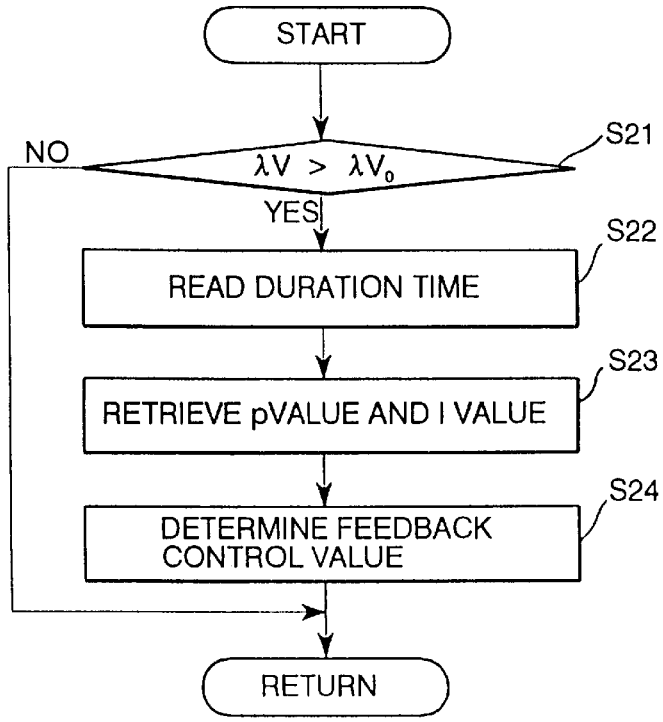
FIG. 8 is a flow chart illustrating the feedback control value setting sequential routine used before effective activation of a linear oxygen sensor.

FIG. 8 shows a flow chart illustrating the sequential routine for setting the feedback correction value before the linear $O_2$ sensor 16 is activated. Control initiates at step S21 at an engine start. At step S21, sensor output $\lambda V$ from the $\lambda O_2$ sensor 17 is compared with the reference sensor output $\lambda V_0$. If the $\lambda O_2$ sensor 17 has been activated, that is, the monitored sensor output V is greater than the reference sensor output $\lambda V_0$, the control proceeds to step S22 where the duration time (T) from the engine start is input. Subsequently, proportional and integral values P and I are read in from the map shown in FIG. 7 at step S23 and retrieved as the feedback correction values at step S24.

Figure 9:
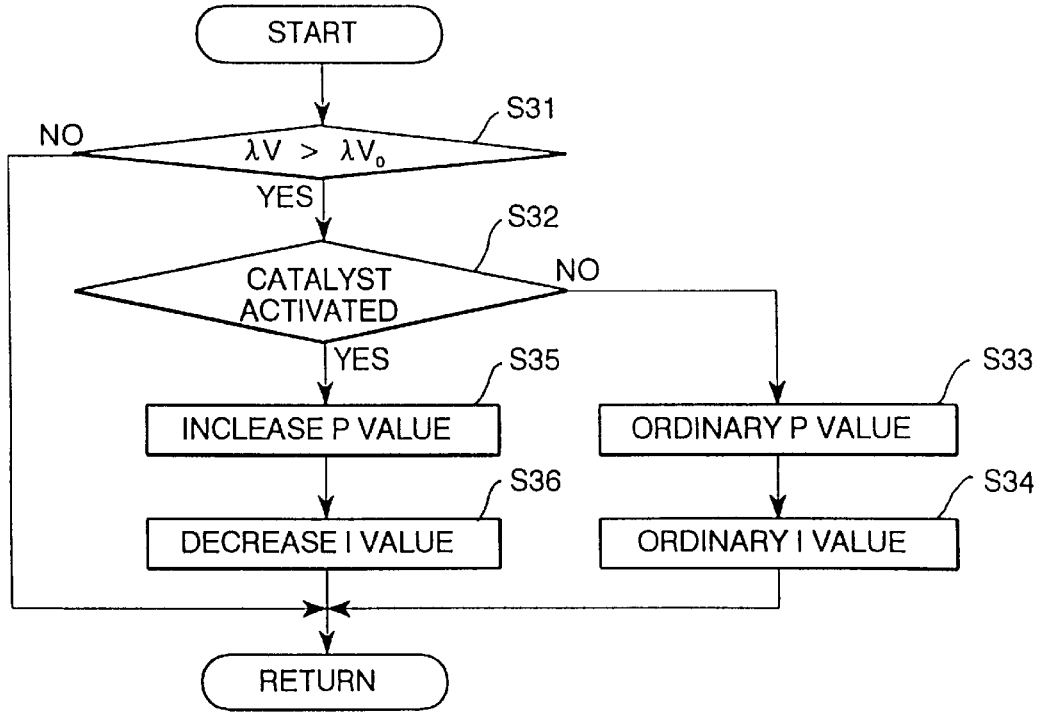
FIG. 9 is a flow chart illustrating a variation of the feedback control value setting sequential routine used before effective activation of a linear oxygen sensor.

The alteration of proportional and integral values P and I during the time period for which the linear $O_2$ sensor 16 is not activated may be otherwise performed unconditionally following activation of the catalytic converter 15 as shown in FIG. 9.

FIG. 9 shows a flow chart illustrating the sequential routine for setting the feedback correction value before the linear $O_2$ sensor 16 is activated. The first step at step S31 is to compare the sensor output $\lambda V$ from the $\lambda O_2$ sensor 17 with the reference sensor output $\lambda V_0$ in order to determine activation of the $\lambda O_2$ sensor 17. If the $\lambda O_2$ sensor 17 has been activated, that is, the $\lambda O_2$ sensor 17 provides a sensor output $\lambda V$ greater than the reference sensor output $\lambda V_0$, the control proceeds to step S32 where a decision is made as to whether or not the catalytic converter 15 has been activated or not. This decision is based on the duration time from the engine start or the temperature of catalytic converter. If the catalytic converter 15 has not yet been activated, then the proportional value P is set at the normal level at step S33, and the integral value I is subsequently set at the normal level at step S34. If the catalytic converter 15 has been activated, then the control proceeds to step S35, at which the proportional value P is set higher than the normal level, and thereafter to step S36 at which the integral value I is set higher than the normal level.

Figure 10:
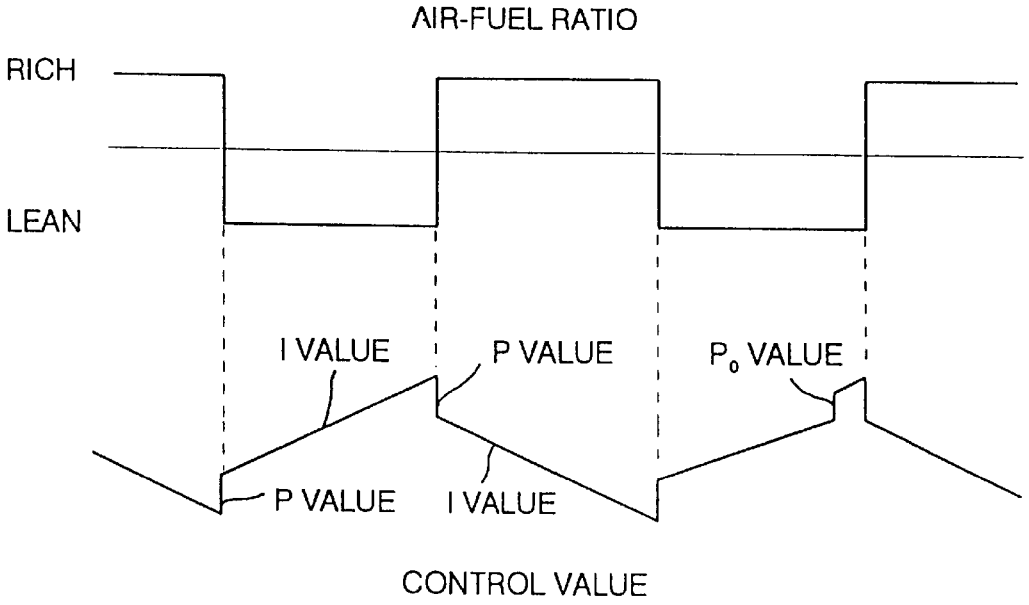
FIG. 10 is a time chart of altering feedback control values used in an air-fuel ratio control system in accordance with another embodiment of the present invention.

Alternatively, only the proportional value P may be increasingly changed in order to set the feedback correction value before both catalytic converter 15 and linear $O_2$ sensor 16 become activated as shown in FIG. 10. Specifically, during the feedback control of the air-fuel ratio based on sensor output $\lambda V$ from the $\lambda O_2$ sensor 17, the control system monitors a duration time (T1, T2, T3) necessary for the $\lambda O_2$ sensor 17 to deliver an air-fuel ratio which has been changed from rich to lean or vice versa. If the air-fuel ratio does not change from rich to lean or vice versa after a reference time duration $T_0$, then a specified value $P_0$ is added to the proportional value P. This, in turn, prevents aggravation of precision in the air-fuel ratio feedback control based on the sensor output from the $\lambda O_2$ sensor 17.

Figure 11:
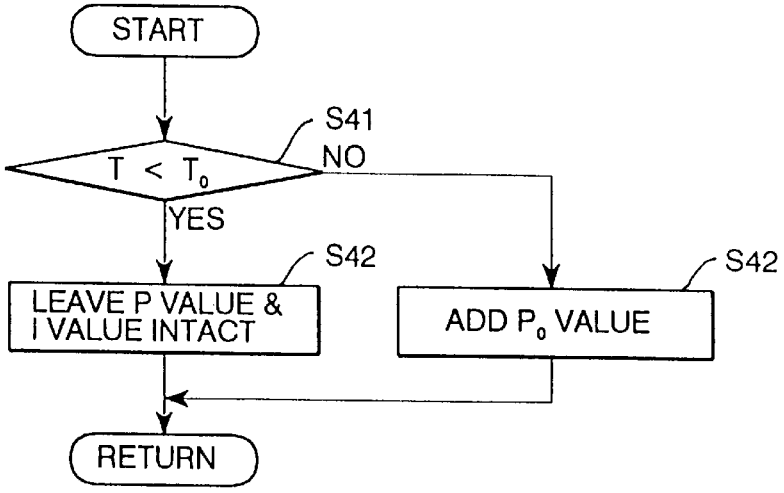
FIG. 11 is a flow chart illustrating a variation of the feedback control value setting sequential routine for the air-fuel ratio control system of FIG. 10.

FIG. 11 shows a flow chart illustrating the sequential routine for setting the proportional value P. If the time duration T is determined to be shorter than the specified time duration $T_0$ at step S41, then the proportional and integral values P and I are left intact at step S42. However, if the time duration T is determined to be equal to or longer than the specified time duration $T_0$ at step S41, then a specified value $P_0$ is added to the proportional value P at step S43.

It is to be understood that although the present invention has been described with regard to preferred embodiments thereof, various other embodiments and variants may occur to those skilled in the art which are within the scope and spirit of the invention. Such other embodiments and variants are intended to be covered by the following claims.

What is claimed is:

1. An air-fuel ratio control system for an internal combustion engine equipped with an exhaust system having a catalytic converter, a linear oxygen ($O_2$) sensor and a lambda oxygen ($\lambda O_2$) sensor, both of the oxygen sensors being capable of monitoring an oxygen content of exhaust gas in said exhaust system, for feedback controlling an air-fuel ratio on the basis of output representative of said oxygen content from at least said linear oxygen ($O_2$) sensor so as to deliver a target air-fuel ratio of a fuel mixture to a combustion chamber of each of a plurality of cylinders of the engine, said lambda oxygen ($\lambda O_2$) sensor being able to be activated earlier than said linear oxygen ($O_2$) sensor, said air-fuel ratio control system comprising:

sensor monitoring means for monitoring effective activation of said linear oxygen ($O_2$) sensor; and shift means for shifting an output used in feedback control of said air-fuel ratio from an output from said linear oxygen ($O_2$) sensor to output from said lambda oxygen ($\lambda O_2$) sensor until said sensor monitoring means detects effective activation of said linear oxygen ($O_2$) sensor.

2. An air-fuel ratio control system as defined in claim 1, wherein said shift means shifts said output from said output from said lambda oxygen ($\lambda O_2$) sensor to said output from said linear oxygen ($O_2$) sensor after said sensor monitoring means detects effective activation of said linear oxygen ($O_2$) sensor.

3. An air-fuel ratio control system as defined in claim 1, wherein said linear oxygen ($O_2$) sensor and said lambda oxygen ($\lambda O_2$) sensor are disposed in said exhaust system before and after said catalytic converter, respectively, and said sensor monitoring means further detects at least one of deterioration of said catalytic converter and malfunction of said linear oxygen ($O_2$) sensor on the basis of said output from both said linear oxygen ($O_2$) sensor and said lambda oxygen ($\lambda O_2$) sensor.

4. An air-fuel ratio control system as defined in claim 3, and further comprising exhaust gas bypass means installed at said exhaust system for allowing exhaust gas to bypass said catalytic converter and enter immediately before said lambda oxygen ($\lambda O_2$) sensor, catalyst monitoring means for monitoring activity of said catalytic converter, and bypass control means for causing said exhaust gas bypass means to open and close.

5. An air-fuel ratio control system as defined in claim 4, wherein said exhaust gas bypass means comprises a conduit and a valve disposed in said conduit and operated by said bypass control means to close said conduit after said catalyst monitoring means has detected effective activation of said catalytic converter but before said sensor monitoring means detects effective activation of said linear oxygen ($O_2$) sensor.

6. An air-fuel ratio control system as defined in claim 4, wherein said air-fuel control system utilizes, in said feedback control, a proportional control value and an integral control value established based on said output from at least one of said linear oxygen ($O_2$) sensor and said lambda oxygen ($\lambda O_2$) sensor.

7. An air-fuel ratio control system as defined in claim 6, wherein said air-fuel ratio control system alters said integral control value so that it is smaller than an ordinary integral control value according to an activated condition of said catalytic converter monitored by said catalyst monitoring means before said sensor monitoring means detects effective activation of said linear oxygen ($O_2$) sensor.

8. An air-fuel ratio control system as defined in claim 6, wherein said air-fuel ratio control system alters said proportional control value so that it is greater than an ordinary proportional control value according to activity of said catalytic converter monitored by said catalyst monitoring means before said sensor monitoring means detects effective activation of said linear oxygen ($O_2$) sensor.

9. An air-fuel ratio control system as defined in claim 1, wherein said linear oxygen ($O_2$) sensor has an activation temperature higher than said lambda oxygen ($\lambda O_2$) sensor.

10. An air-fuel ratio control system as defined in claim 1, wherein said sensor monitoring means determines a specified time duration after an engine start as being achievement of said effective activation of said linear oxygen ($O_2$).

11. An air-fuel ratio control system as defined in claim 1, wherein said linear oxygen ($O_2$) sensor and said lambda oxygen ($\lambda O_2$) sensor are disposed in said exhaust system before and after said catalytic converter, respectively.

12. An air-fuel ratio control system as defined in claim 11, and further comprising catalyst monitoring means for monitoring activity of said catalytic converter, wherein, until said catalyst monitoring means detects effective activation of said catalyst converter, said air-fuel ratio control system alters an amplitude of a signal relating to air-fuel ratio fluctuations so that it becomes larger according to an activated condition of said catalytic converter monitored by said catalyst monitoring means before said sensor monitoring means detects effective activation of said linear oxygen ($O_2$) sensor than after said sensor monitoring means has detected effective activation of said linear oxygen ($O_2$) sensor.

13. An air-fuel ratio control system as defined in claim 12, wherein said air-fuel ratio control system utilizes, in said feedback control, a proportional control value and an integral control value established based on the output from at least one of said linear oxygen ($O_2$) sensor and said lambda oxygen ($\lambda O_2$) sensor.

14. An air-fuel ratio control system as defined in claim 13, wherein said air-fuel ratio control system alters said proportional control value so that it becomes larger when said catalyst monitoring means detects effective activation of said catalytic converter than at an engine start.

15. An air-fuel ratio control system as defined in claim 14, wherein said air-fuel ratio control system alters said proportional control value so that it becomes larger with progress of time.

16. An air-fuel ratio control system as defined in claim 13, wherein said air-fuel ratio control system alters said proportional control value so that it becomes larger and said integral control value becomes smaller when said catalyst monitoring means detects effective activation of said catalytic converter than at an engine start.

17. An air-fuel ratio control system as defined in claim 16, wherein said air-fuel ratio control system makes said proportional control value larger and said integral control value smaller with progress of time.

18. An air-fuel ratio control system as defined in claim 12, wherein said air-fuel ratio control system establishes an initial feedback control value according to an air-fuel ratio determined by output from at least one of said linear oxygen ($O_2$) sensor and said lambda oxygen ($\lambda O_2$) sensor, and alters said initial feedback control value by a specified value if said air-fuel ratio changes between a rich side and a lean side after a specified time duration from the beginning of said feedback control with said initial feedback control value.

19. An air-fuel ratio control system as defined in claim 11, and further comprising catalyst monitoring means for monitoring activity of said catalytic converter, wherein said air-fuel ratio control system restrains a change in frequency of air-fuel ratio fluctuations according to an activated condition of said catalytic converter monitored by said catalyst monitoring means before said sensor monitoring means detects effective activation of said linear oxygen ($O_2$) sensor.

20. An air-fuel ratio control system for an internal combustion engine equipped with an exhaust system having a catalytic converter, a linear oxygen ($O_2$) sensor disposed upstream from said catalytic converter and a lambda oxygen ($\lambda O_2$) sensor disposed downstream from said catalytic converter, both of said oxygen sensors being capable of monitoring an oxygen content of exhaust gas from said engine and said lambda oxygen ($\lambda O_2$) sensor being able to be activated earlier than said linear oxygen ($O_2$) sensor, and an intake system having an air flow sensor and a fuel injector arranged in this order from the upstream end for feedback controlling an air-fuel ratio on the basis of an output representative of said oxygen content from at least said linear oxygen ($O_2$) sensor so as to deliver a target air-fuel ratio of a fuel mixture to a combustion chamber of each of a plurality of cylinders of the engine, said air-fuel ratio control system comprising:

a speed sensor for monitoring an engine speed of rotation;

a timer for counting a time specified for activation of said linear oxygen ($O_2$) sensor from a start of said engine; and a control unit for calculating a target air-fuel ratio on the basis of said engine speed of rotation and an amount of charged air, determining a basic injection amount of fuel on the basis of said engine speed of rotation and an amount of intake air monitored by said air flow sensor, and causing said fuel injector to inject fuel according to said basic injection amount of fuel added by a feedback variable obtained on the basis of said target air-fuel ratio and an oxygen content of exhaust gas which is represented by an output from said linear oxygen ($O_2$) sensor before a lapse of said specified time and by an output from lambda oxygen ($\lambda O_2$) after a lapse of said specified time.

* * * * *